US011710434B2

(12) United States Patent
Fu

(10) Patent No.: US 11,710,434 B2
(45) Date of Patent: Jul. 25, 2023

(54) DISPLAY DEVICE AND ELECTRONIC EQUIPMENT

(71) Applicant: TCL China Star Optoelectronics Technology Co., Ltd., Shenzhen (CN)

(72) Inventor: Xiaoli Fu, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/960,554

(22) PCT Filed: Apr. 24, 2020

(86) PCT No.: PCT/CN2020/086678

§ 371 (c)(1),
(2) Date: Jul. 8, 2020

(87) PCT Pub. No.: WO2021/203493

PCT Pub. Date: Oct. 14, 2021

(65) Prior Publication Data

US 2023/0120315 A1 Apr. 20, 2023

(30) Foreign Application Priority Data

Apr. 10, 2020 (CN) ..... 202010280208.9

(51) Int. Cl.
*G09G 3/20* (2006.01)

(52) U.S. Cl.
CPC ..... *G09G 3/20* (2013.01); *G09G 2300/0408* (2013.01); *G09G 2300/0861* (2013.01); *G09G 2300/0871* (2013.01); *G09G 2310/0202* (2013.01); *G09G 2310/08* (2013.01)

(58) Field of Classification Search
CPC combination set(s) only.
See application file for complete search history.

(56) References Cited

U.S. PATENT DOCUMENTS 4,412,450 A * 11/1983 Franz ..... G01F 25/24 73/304 C
4,491,712 A * 1/1985 Ito ..... B23H 7/28 219/69.19
2013/0307575 A1 11/2013 Peng et al.
(Continued)

FOREIGN PATENT DOCUMENTS

CN 101707054 A 5/2010
CN 101719352 A 6/2010
(Continued)

OTHER PUBLICATIONS

CN110491331A Nov. 22, 2019 Zhao Jing Display panel, driving method thereof and display device (Year: 2019).*

*Primary Examiner* — Van N Chow
(74) *Attorney, Agent, or Firm* — Nathan & Associates; Menachem Nathan

(57) ABSTRACT

In a display device, transistors are disposed on a display panel. When the display panel has a short-circuit, the timing controller sends a signal to the level shifter to disconnect the transistors, causing the display panel to no longer receive scanning signals transmitted from GOA circuits, causing the display panel enter an overcurrent protection state, and thus preventing GOA wirings in the display panel from burning out in an event of the short-circuit.

18 Claims, 6 Drawing Sheets

(56) References Cited

U.S. PATENT DOCUMENTS

| | | | | |
|---|---|---|---|---|
| 2014/0084941 | A1* | 3/2014 | Yun | G09G 3/3233 324/543 |
| 2015/0077243 | A1* | 3/2015 | Hooper | G08B 17/06 340/532 |
| 2016/0054368 | A1 | 2/2016 | Yang et al. | |
| 2016/0163276 | A1 | 6/2016 | Hsu | |
| 2018/0123457 | A1* | 5/2018 | Yaguchi | H02M 1/4225 |
| 2018/0151142 | A1 | 5/2018 | Tian | |
| 2018/0330650 | A1* | 11/2018 | Wu | H01L 27/0255 |
| 2020/0076182 | A1 | 3/2020 | Huang | |

FOREIGN PATENT DOCUMENTS

| | | | |
|---|---|---|---|
| CN | 103247276 | A | 8/2013 |
| CN | 104318880 | A | 1/2015 |
| CN | 104464667 | A | 3/2015 |
| CN | 106409263 | A | 2/2017 |
| CN | 107481693 | A | 12/2017 |
| CN | 109103842 | A | 12/2018 |
| CN | 110444141 | A | 11/2019 |
| CN | 110491331 | A | 11/2019 |
| JP | 2003216126 | A | 7/2003 |

* cited by examiner

DISPLAY DEVICE AND ELECTRONIC EQUIPMENT

FIELD OF INVENTION

The present disclosure relates to the field of display technologies, and particularly relates to a display device and an electronic equipment.

BACKGROUND OF INVENTION

Conventional gate driver on array (GOA) panels generally use a peripheral drive circuit for overcurrent protection (OCP), so as to prevent GOA wirings in the GOA panels from burning out in event of a short-circuit.

In conventional GOA panels, when a level conversion module of a peripheral drive circuit board detects a large current, the level conversion module outputs a feedback level to an analog circuit module of the peripheral drive circuit board, so that the analog circuit module no longer outputs an analog voltage to the display panel and the display panel enters an OCP protection state. Thus, it can be seen that a structure of the OCP protection circuit of the conventional GOA panels is complicated and an effect of the OCP protection circuit of the conventional GOA panels is poor.

Technical Problems

The present disclosure provides a display device and an electronic equipment to solve technical problems of complicated structure and poor effect of the OCP protection circuit of the GOA panels in prior art.

Technical Solutions

The present disclosure provides a display device. The display device includes a display panel, a level shifter connected to the display panel, and a timing controller connected to the level shifter, wherein a GOA circuit and a switch module are disposed on the display panel, the switch module is connected to the level shifter, and the GOA circuit is electrically connected to scanning lines on the display panel through the switch module; and wherein when the level shifter detects an occurrence of a short-circuit of the display panel, the level shifter sends a feedback signal to the timing controller, the timing controller sends a short-circuit protection signal to the level shifter according to the feedback signal, and the level shifter outputs a disconnection signal to the switch module according to the short-circuit protection signal to disconnect the switch module.

In the display device provided by the present disclosure, the GOA circuit includes a plurality of GOA units, the switch module includes a plurality of transistors, and the GOA units are in a one-to-one correspondence to the transistors, wherein a gate electrode of each of the transistors is electrically connected to the level shifer, a source electrode of each of the transistors is electrically and correspondingly connected to a scanning signal output terminal of the GOA units, and a drain electrode of each of the transistors is electrically and correspondingly connected to the scanning lines on the display panel.

In the display device provided by the present disclosure, the transistors are field effect transistors, middle terminals of the field effect transistors are gate electrodes, signal input terminals of the field effect transistors are source electrodes, and signal output terminals of the field effect transistors are drain electrodes.

In the display device provided by the present disclosure, the GOA circuit includes a plurality of GOA units arranged in cascade, and the switch module includes a transistor, wherein a gate electrode of the transistor is electrically connected to the level shifter, a source electrode of the transistor is electrically connected to an output terminal of a $1^{st}$-level GOA unit, and a drain electrode of the transistor is correspondingly connected to the scanning lines on the display panel and a stage transmission input terminal of a $2^{nd}$-level GOA unit.

In the display device provided by the present disclosure, the GOA circuit includes a plurality of GOA units arranged in cascade, and the switch module includes a transistor, wherein a gate electrode of the transistor is electrically connected to the level shifter, a source electrode of the transistor is electrically connected to an output terminal of an initial stage transmission signal, a drain electrode of the transistor is connected to a stage transmission input terminal of a $1^{st}$-level GOA unit.

In the display device provided by the present disclosure, the GOA circuit includes a plurality of GOA units arranged in cascade, and the switch module includes a first transistor and a second transistor, wherein a gate electrode of the first transistor and a gate electrode of the second transistor are electrically connected to the level shifter, a source electrode of the first transistor and a source electrode of the second transistor are electrically connected to an output terminal of a $1^{st}$-level GOA unit, a drain electrode of the first transistor is correspondingly connected to the scanning lines on the display panel, and a drain electrode of the second transistor is electrically connected to a stage transmission input terminal of a $2^{nd}$-level GOA unit.

In the display device provided by the present disclosure, the switch module further includes a plurality of third transistors, the third transistors are in a one-to-one correspondence to the GOA units except the $1^{st}$-level GOA unit and the $2^{nd}$-level GOA unit, wherein gate electrodes of the third transistors are electrically connected to the level shifter, source electrodes of the third transistors are electrically and correspondingly connected to output terminals of the GOA units, and a drain electrode of each of the third transistors is electrically connected to a stage transmission input terminal of one of the GOA units at a next level of the corresponding GOA unit.

In the display device provided by the present disclosure, the switch module includes at least two first transistors and at least two second transistors, the first transistors are connected in series, and the second transistors are connected in series.

In the display device provided by the present disclosure, the GOA circuit includes a plurality of odd level GOA units arranged in cascade and a plurality of even level GOA units arranged in cascade, and the switch module includes a plurality of fourth transistors and a plurality of fifth transistors, wherein in the plurality of odd level GOA units arranged in cascade, the fourth transistors are electrically connected to the level shifter and the display panel, and in the plurality of even level GOA units arranged in cascade, the fifth transistors are electrically connected to the level shifter and the display panel.

The present disclosure further provides an electronic equipment. The electronic equipment includes a display panel, a level shifter connected to the display panel, and a timing controller connected to the level shifter, wherein a GOA circuit and a switch module are disposed on the display panel, the switch module is connected to the level shifter, and the GOA circuit is electrically connected to scanning lines on the display panel through the switch module; and wherein when the level shifter detects an occurrence of a short-circuit of the display panel, the level shifter sends a feedback signal to the timing controller, the timing controller sends a short-circuit protection signal to the level shifter according to the feedback signal, and the level shifter outputs a disconnection signal to the switch module according to the short-circuit protection signal to disconnect the switch module.

In the electronic equipment provided by the present disclosure, the GOA circuit includes a plurality of GOA units, the switch module includes a plurality of transistors, and the GOA units are in a one-to-one correspondence to the transistors, wherein a gate electrode of each of the transistors is electrically connected to the level shifter, a source electrode of each of the transistors is electrically and correspondingly connected to a scanning signal output terminal of the GOA units, and a drain electrode of each of the transistors is electrically and correspondingly connected to the scanning lines on the display panel.

In the electronic equipment provided by the present disclosure, the transistors are field effect transistors, middle terminals of the field effect transistors are gate electrodes, signal input terminals of the field effect transistors are source electrodes, and signal output terminals of the field effect transistors are drain electrodes.

In the electronic equipment provided by the present disclosure, the GOA circuit includes a plurality of GOA units arranged in cascade, and the switch module includes a transistor, wherein a gate electrode of the transistor is electrically connected to the level shifter, a source electrode of the transistor is electrically connected to an output terminal of a $1^{st}$-level GOA unit, and a drain electrode of the transistor is correspondingly connected to the scanning lines on the display panel and a stage transmission input terminal of a $2^{nd}$-level GOA unit.

In the electronic equipment provided by the present disclosure, the GOA circuit includes a plurality of GOA units arranged in cascade, and the switch module includes a transistor, wherein a gate electrode of the transistor is electrically connected to the level shifter, a source electrode of the transistor is electrically connected to an output terminal of an initial stage transmission signal, a drain electrode of the transistor is connected to a stage transmission input terminal of a $1^{st}$-level GOA unit.

In the electronic equipment provided by the present disclosure, the GOA circuit includes a plurality of GOA units arranged in cascade, and the switch module includes a first transistor and a second transistor, wherein a gate electrode of the first transistor and a gate electrode of the second transistor are electrically connected the level shifter, a source electrode of the first transistor and a source electrode of the second transistor are electrically connected to an output terminal of a $1^{st}$-level GOA unit, a drain electrode of the first transistor is correspondingly connected to the scanning lines on the display panel, and a drain electrode of the second transistor is electrically connected to a stage transmission input terminal of a $2^{nd}$-level GOA unit.

In the electronic equipment provided by the present disclosure, the switch module further includes a plurality of third transistors, the third transistors are in a one-to-one correspondence to the GOA units except the $1^{st}$-level GOA unit and the $2^{nd}$-level GOA unit, wherein gate electrodes of the third transistors are electrically connected to the level shifter, source electrodes of the third transistors are electrically and correspondingly connected to output terminals of the GOA units, and a drain electrode of each of the third transistors is electrically connected to a stage transmission input terminal of one of the GOA units at a next level of the corresponding GOA unit.

In the electronic equipment provided by the present disclosure, the switch module includes at least two first transistors and at least two second transistors, the first transistors are connected in series, and the second transistors are connected in series.

In the electronic equipment provided by the present disclosure, the GOA circuit includes a plurality of odd level GOA units arranged in cascade and a plurality of even level GOA units arranged in cascade, and the switch module includes a plurality of fourth transistors and a plurality of fifth transistors, wherein in the plurality of odd level GOA units arranged in cascade, the fourth transistors are electrically connected to the level shifter and the display panel, and in the plurality of even level GOA units arranged in cascade, the fifth transistors are electrically connected to the circuit board and the display panel.

Beneficial Effects

In the display device and the electronic equipment provided by the present disclosure, the transistors are disposed on the display panel, when the display panel has a short-circuit, the level shifter will detect a large current in the display panel and send a signal to the timing controller, the timing controller sends a feedback signal to the level shifter, and then the level shifter will disconnect the transistors, so as to make the display panel cannot receive scanning signals transmitted from the GOA circuit, which makes the display panel enter the overcurrent protection state to prevent GOA wirings in the display panel from burning out in event of a short-circuit. Therefore, a structure of the display device provided by the present disclosure is simple, the overcurrent protection of the display device provided by the present disclosure is effective, and the technical problems of complicated structure and poor effect of the OCP protection circuit in conventional GOA panels can be solved.

DESCRIPTION OF DRAWINGS

Following describes specific implementations of the present disclosure in detail with reference to accompanying drawings, which will make the technical solutions and other beneficial effects of the present disclosure obvious. Obviously, the accompanying drawings described below are only part of embodiments of the present disclosure, from which drawings those skilled in the art can derive further drawings without making any inventive efforts.

DETAILED DESCRIPTION OF EMBODIMENTS

A clearly and completely description of the technical solution will be given in combination with the accompanying drawings in the embodiments of the present disclosure. It is evident that the embodiments described are only a part of embodiments of the present disclosure and not all of them. Based on the embodiment of the present disclosure, all other embodiments obtained by those skilled in the art without making any invention efforts all belong to the scope of protection in the present disclosure.

Figure 1:
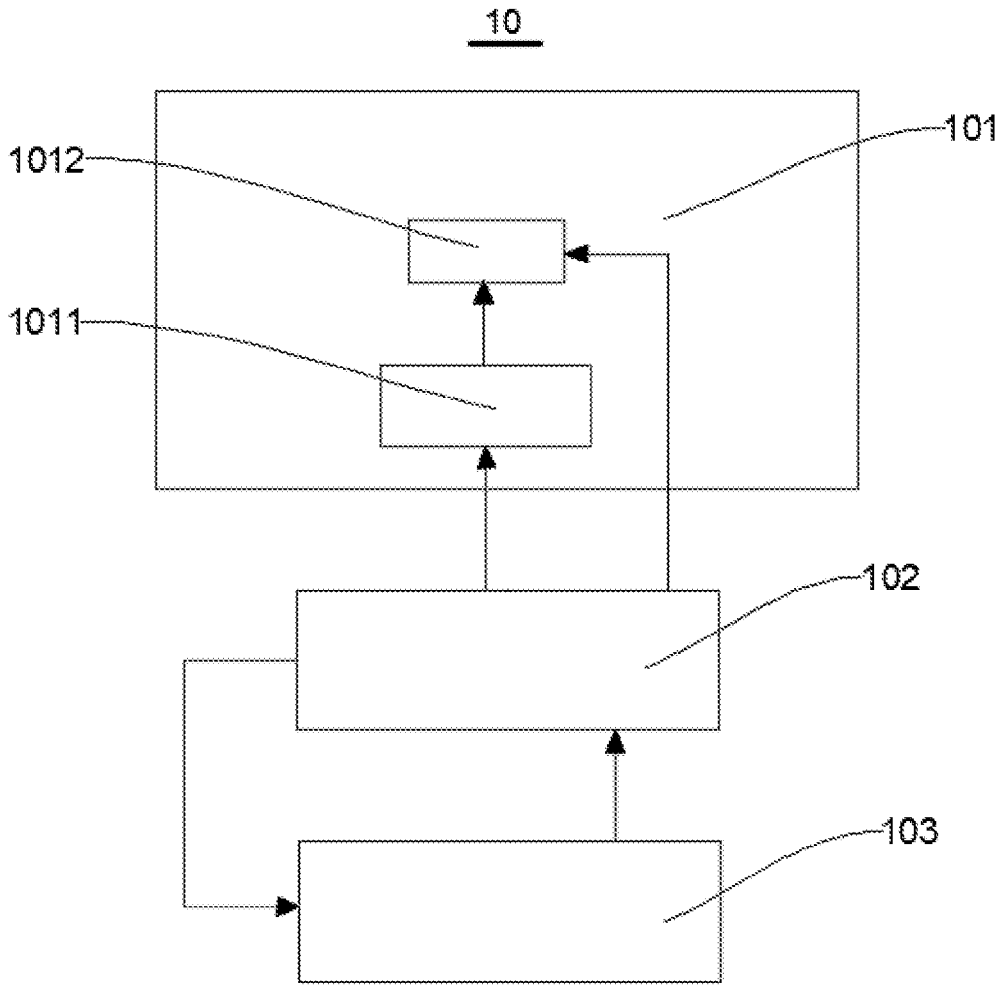
FIG. 1 is a first structure schematic view of a display device provided in an embodiment of the present disclosure.

Referring to FIG. 1, FIG. 1 is a first structure schematic view of a display device provided in an embodiment of the present disclosure. As shown in FIG. 1, an embodiment of the present disclosure provides a display device 10. The display device 10 includes a display panel 101, a level shifter 102 connected to the display panel 101, and a timing controller 103 connected to the level shifter 102. Wherein a GOA circuit 1011 and a switch module 1012 are disposed on the display panel 101, the switch module 1012 is connected to the level shifter 102, and the GOA circuit 1011 is electrically connected to scanning lines on the display panel 101 through the switch module 1012.

Wherein, it can be understood that when the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, and the level shifter 102 outputs a disconnection signal to the switch module 1012 according to the short-circuit protection signal to disconnect the switch module 1012, thereby blocking the GOA circuit 1011 from outputting scanning signals to corresponding scanning lines on the display panel 101. In this way, the display panel 101 cannot display and enters an overcurrent protection state to prevent GOA wirings in the display panel 101 from burning out in event of a short-circuit.

Figure 2:
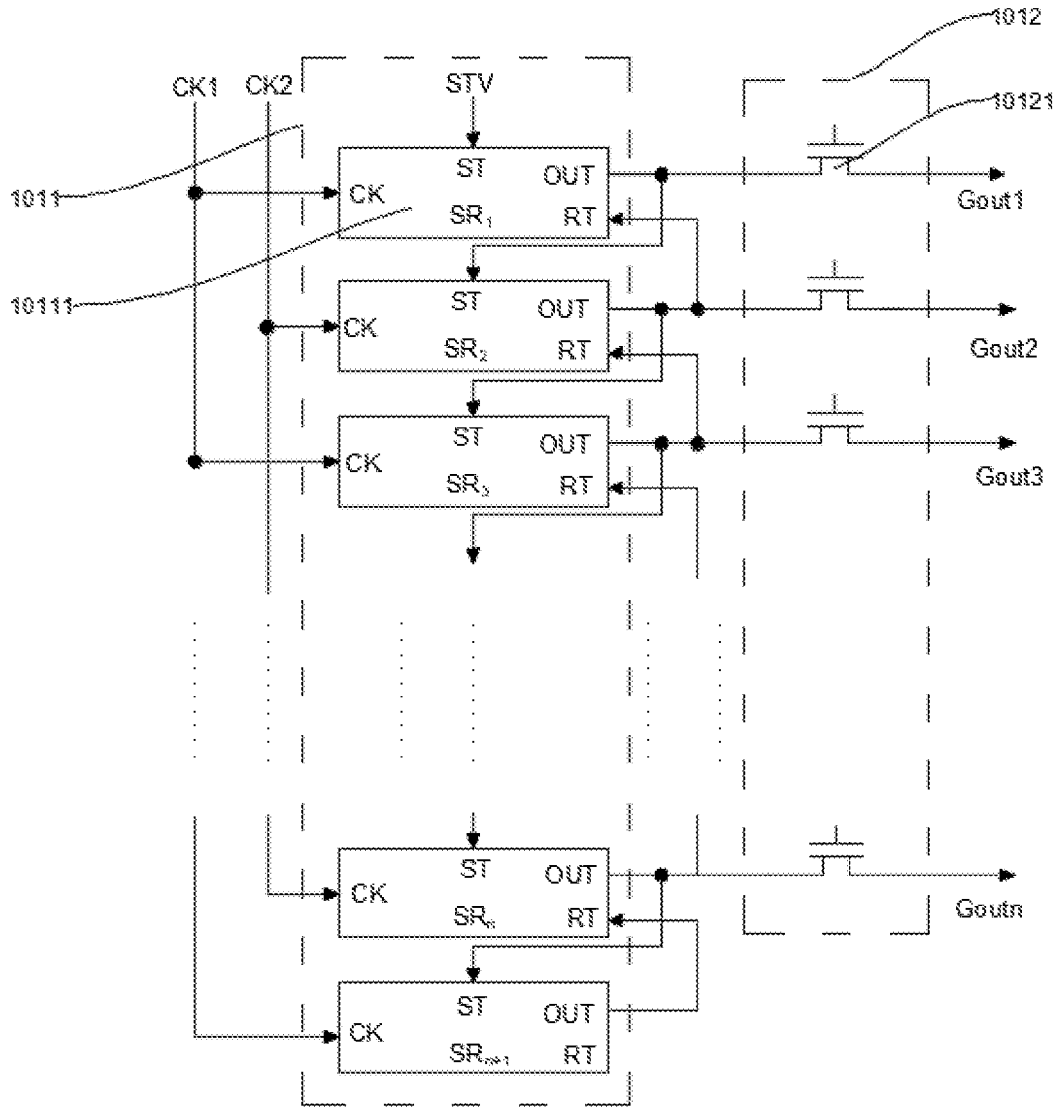
FIG. 2 is a second structure schematic view of the display device provided in an embodiment of the present disclosure.

Furthermore, referring to FIG. 1 and FIG. 2, FIG. 2 is a second structure schematic view of the display device provided in an embodiment of the present disclosure. As shown in FIG. 2, in an overcurrent protection circuit of the display device provided in the embodiment of the present disclosure, the GOA circuit 1011 includes a plurality of GOA units 10111, the switch module 1012 includes a plurality of transistors 10121, and the GOA units 10111 are in a one-to-one correspondence to the transistors 10121. Wherein a gate electrode of each of the transistors 10121 is electrically connected to the level shifter 102, a source electrode of each of the transistors 10121 is electrically and correspondingly connected to a scanning signal output terminal of the GOA units 10111, and a drain electrode of each of the transistors 10121 is electrically and correspondingly connected to the scanning lines on the display panel 101.

When the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, and the level shifter 102 outputs a disconnection signal to the switch module 1012 according to the short-circuit protection signal to disconnect the transistors 10121, so that the GOA units 10111 in the GOA circuit 1011 cannot transmit scanning signals to the scanning lines corresponding to the GOA units 10111, thereby blocking the GOA units 10111 from outputting the scanning signals to the display panel 101. In this way, the display panel 101 cannot display and enters the overcurrent protection state to prevent the GOA wirings in the display panel 101 from burning out in the event of the short-circuit.

It can be understood that the GOA units 10111 are in a one-to-one correspondence to the transistors 10121, and a number of the GOA units 10111 is same as a number of the transistors 10121. A transistor 10121 is disposed between an output terminal of each of the GOA units 10111 and a scanning line corresponding to each of the GOA units 10111, so that the display panel 101 will not receive any scanning signal transmitted from the GOA circuit 1011 after the transistor 10121 is disconnected.

Wherein, the transistors 10121 adopted in the embodiment of the present disclosure are field effect transistors. Because source electrodes of the field effect transistors and drain electrodes of the field effect transistors are symmetrical, the source electrodes and the drain electrodes of the field effect transistors can be interchanged. In the embodiment of the present disclosure, in order to distinguish two kinds of electrodes except gate electrodes of the transistors 10121, it is specified that middle terminals of the field effect transistors are the gate electrodes, signal input terminals of the field effect transistors are the source electrodes, and signal output terminals of the field effect transistors are the drain electrodes.

In one embodiment, the transistors 10121 may also be thin film transistors or other transistors having same characteristics as the thin film transistor and the field effect transistor.

Each of the transistors 10121 provided in the embodiment of the present disclosure is an N-type transistor. Wherein, the N-type transistor is reconnected when a gate electrode of the N-type transistor is at a high level and the N-type transistor is disconnected when the gate electrode of the N-type transistor is at a low level. In the embodiment of the present disclosure, when the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, the level shifter 102 outputs a low level signal to the transistors 10121 according to the short-circuit protection signal to disconnect the transistors 10121. However, when the display panel displays normally, the level shifter outputs a high-level signal to the transistors 10121 to reconnect the transistors 10121.

Figure 3:
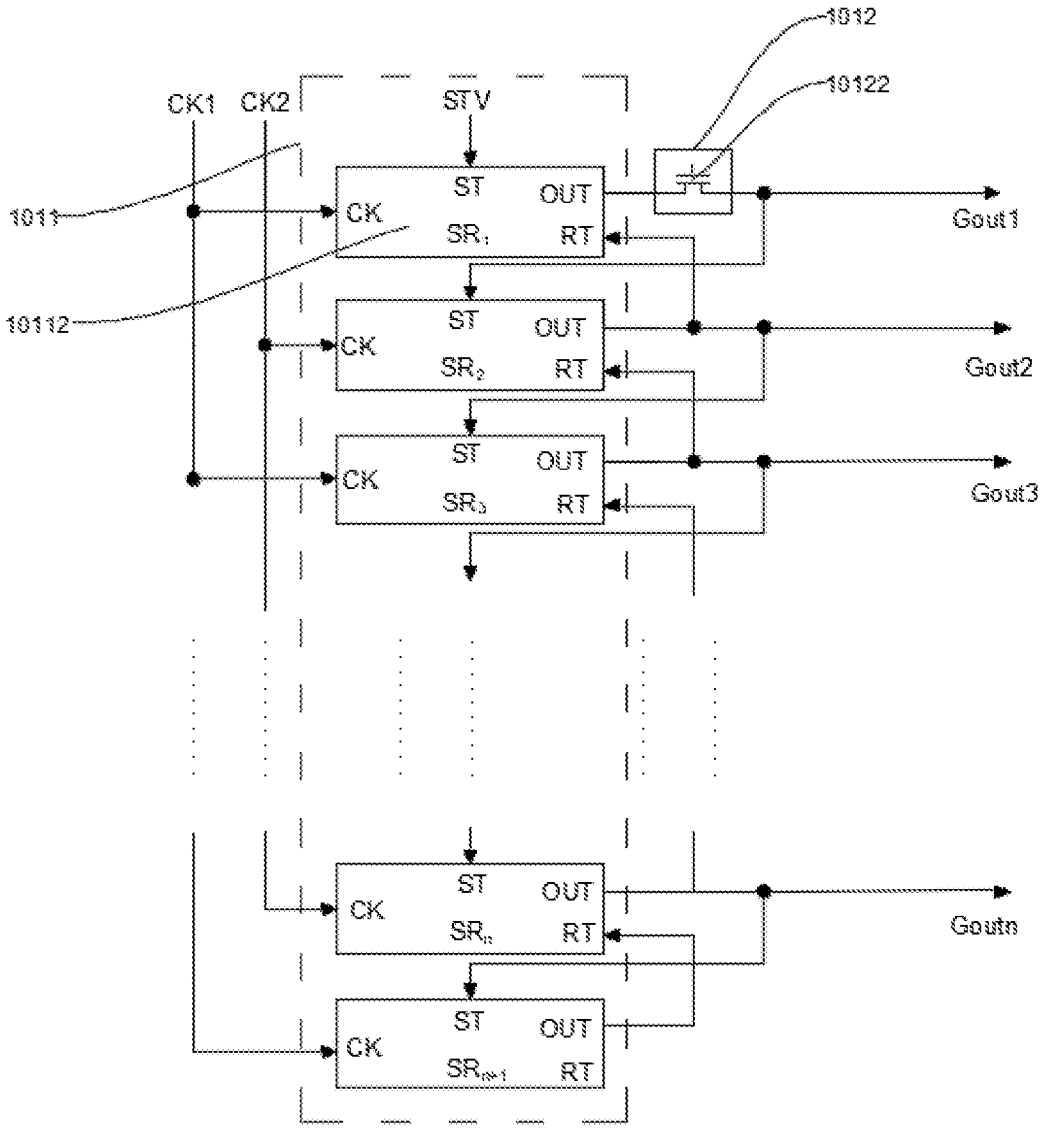
FIG. 3 is a third structure schematic view of the display device provided in an embodiment of the present disclosure.

Referring to FIG. 1 and FIG. 3, FIG. 3 is a third structure schematic view of the display device provided in an embodiment of the present disclosure. As shown in FIG. 3, in an overcurrent protection circuit of the display device provided in the embodiment of the present disclosure, the GOA circuit 1011 includes a plurality of GOA units 10112 arranged in cascade, and the switch module 1012 includes a transistor 10122. Wherein a gate electrode of the transistor 10122 is electrically connected to the level shifter 102, a source electrode of the transistor 10122 is electrically connected to an output terminal of a $1^{st}$-level GOA unit 10112, and a drain electrode of the transistor 10122 is correspondingly connected to the scanning lines on the display panel 101 and a stage transmission input terminal of a $2^{nd}$-level GOA unit 10112.

It can be understood that there is only one transistor 10122 disposed in the embodiment of the present disclosure, when the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, and the level shifter 102 outputs a control signal to the transistor 10122 according to the short-circuit protection signal to disconnect the transistors 10122. When the transistor 10122 is disconnected, as the source electrode of the transistor 10122 is electrically connected to the output terminal of the $1^{st}$-level GOA unit 10112, and the drain electrode of the transistor 10122 is correspondingly connected to the scanning lines on the display panel 101, a scanning signal transmitted from the $1^{st}$-level GOA unit 10112 to the display panel 101 will be blocked by the transistor 10122. And as the source electrode of the transistor 10122 is electrically connected to the output terminal of the $1^{st}$-level GOA unit 10112, the drain electrode of the transistor 10122 is electrically connected to the stage transmission input terminal of the $2^{nd}$-level GOA unit 10112, and the GOA circuit 1011 in the embodiment of the present disclosure is composed of the plurality of GOA units 10112 arranged in cascade, the $2^{nd}$-level GOA unit 10112 also fails to receive a stage transmission signal output by the $1^{st}$-level GOA unit 10112. As a result, neither the $2^{nd}$-level GOA unit 10112 nor the subsequent GOA units 10112 can receive the stage transmission signal, and thus the GOA units 10112 cannot output the scanning signals to the display panel 101. In this way, the display panel 101 cannot receive any scanning signal transmitted from the GOA circuit 1011.

Figure 4:
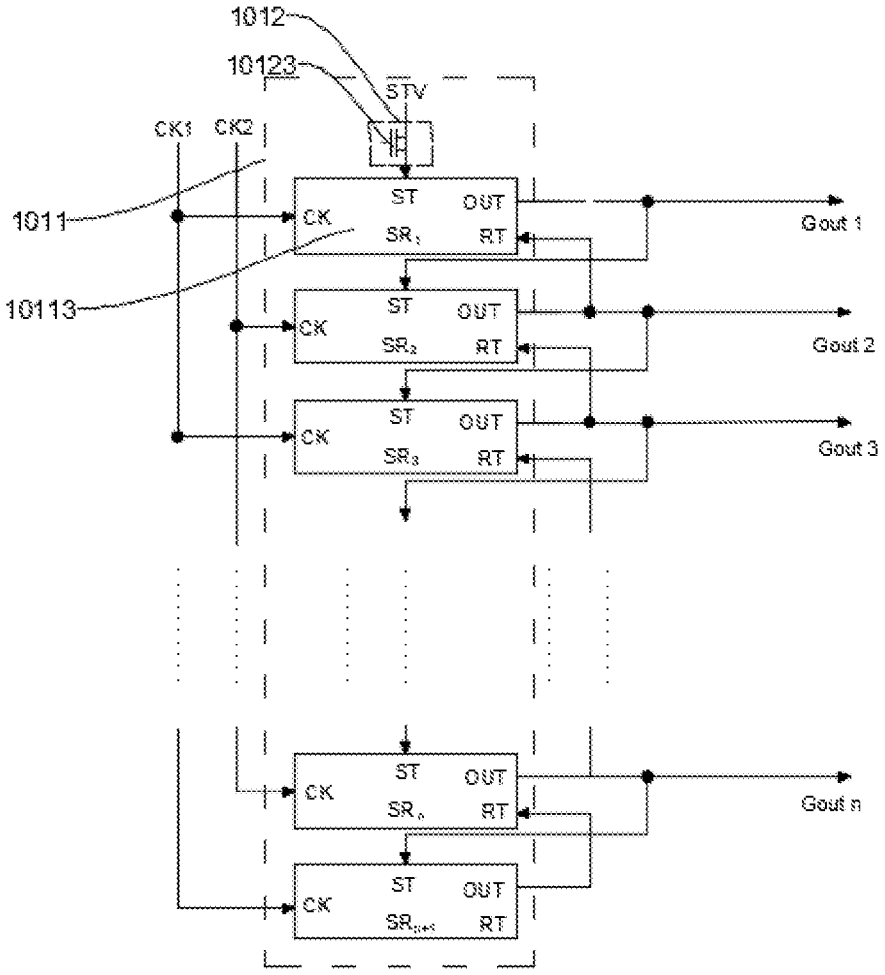
FIG. 4 is a fourth structure schematic view of the display device provided in an embodiment of the present disclosure.

Referring to FIG. 1 and FIG. 4, FIG. 4 is a fourth structure schematic view of the display device provided in an embodiment of the present disclosure. As shown in FIG. 4, in an overcurrent protection circuit of the display device provided in the embodiment of the present disclosure, the GOA circuit 1011 includes a plurality of GOA units 10113 arranged in cascade, and the switch module 1012 includes a transistor 10123. Wherein a gate electrode of the transistor 10123 is electrically connected to the level shifter 102, a source electrode of the transistor 10123 is electrically connected to an output terminal of an initial stage transmission signal, a drain electrode of the transistor 10123 is connected to a stage transmission input terminal of a $1^{st}$-level GOA unit 10113.

It can be understood that there is only one transistor 10123 disposed in the embodiment of the present disclosure, when the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, and the level shifter 102 outputs a control signal to the transistor 10123 according to the short-circuit protection signal to disconnect the transistors 10123. When the transistor 10123 is disconnected, as the source electrode of the transistor 10123 is electrically connected to the output terminal of the initial stage transmission signal, the drain electrode of the transistor 10123 is connected to the stage transmission input terminal of the $1^{st}$-level GOA unit 10113, an initial stage transmission signal will be blocked before it is transmitted to the $1^{st}$-level GOA unit 10113, all GOA units 10113 will fail and will not transmit scanning signals to the display panel 101. In this way, the display panel 101 cannot receive any scanning signal transmitted from the GOA circuit 1011.

Figure 5:
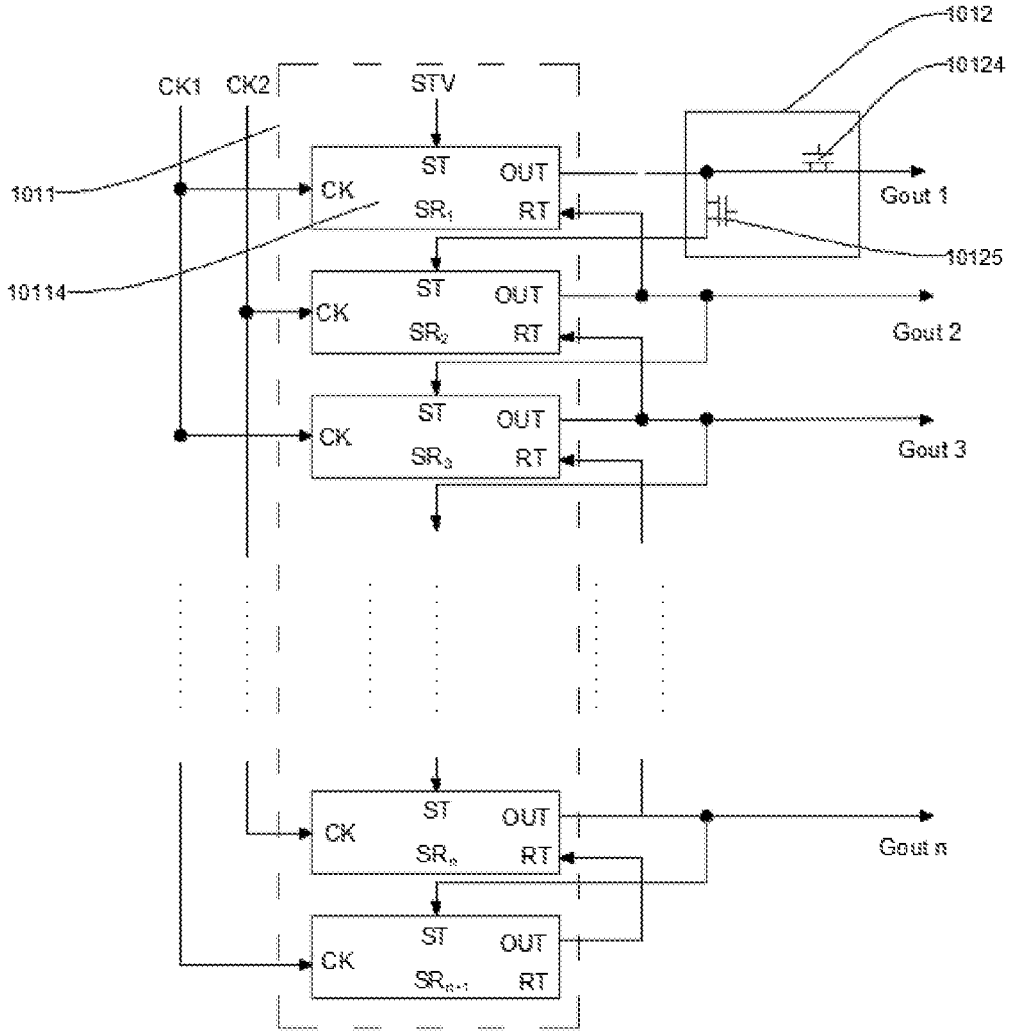
FIG. 5 is a fifth structure schematic view of the display device provided in an embodiment of the present disclosure.

Referring to FIG. 1 and FIG. 5, FIG. 5 is a fifth structure schematic view of the display device provided in an embodiment of the present disclosure. As shown in FIG. 5, in an overcurrent protection circuit of the display device provided in the embodiment of the present disclosure, the GOA circuit 1011 includes a plurality of GOA units 10114 arranged in cascade, and the switch module 1012 includes a first transistor 10124 and a second transistor 10125. Wherein a gate electrode of the first transistor 10124 and a gate electrode of the second transistor 10125 are electrically connected to the level shifter 102, a source electrode of the first transistor 10124 and a source electrode of the second transistor 10125 are electrically connected to an output terminal of a $1^{st}$-level GOA unit 10114, a drain electrode of the first transistor 10124 is correspondingly connected to the scanning lines on the display panel 101, and a drain electrode of the second transistor 10125 is electrically connected to a stage transmission input terminal of a $2^{nd}$-level GOA unit 10114.

It can be understood that when the display panel 101 has an internal short-circuit, a large current is generated in the display panel 101 and flows to the level shifter 102, the level shifter 102 sends a feedback signal to the timing controller 103, the timing controller 103 sends a short-circuit protection signal to the level shifter 102 according to the feedback signal, and the level shifter 102 outputs a control signal to the first transistor 10124 and the second transistor 10125 according to the short-circuit protection signal to disconnect the first transistor 10124 and the second transistor 10125. As the source electrode of the first transistor 10124 is electrically connected to the output terminal of the $1^{st}$-level GOA unit 10114, and the drain electrode of the first transistor 10124 is correspondingly connected to the scanning lines on the display panel 101, when the first transistor 10124 is disconnected, the $1^{st}$-level GOA unit 10114 cannot transmit a scanning signal to the display panel 101, and as the source electrode of the second transistor 10125 is electrically connected to the output terminal of the $1^{st}$-level GOA unit 10114, the drain electrode of the second transistor 10125 is electrically connected to the stage transmission input terminal of the $2^{nd}$-level GOA unit 10114, the $1^{st}$-level GOA unit 10114 cannot transmit a stage transmission signal to the $2^{nd}$-level GOA unit 10114. As a result, neither the $2^{nd}$-level GOA unit 10114 nor the subsequent GOA units 10114 can receive the stage transmission signal, and thus the GOA units 10114 cannot output the scanning signals to the display panel 101. In this way, the GOA circuit 1011 cannot output the scanning signals to the display panel 101.

In one embodiment, a plurality of third transistors are further disposed in the display device provided by the present disclosure. The third transistors are in a one-to-one correspondence to the GOA units 10114 except the $1^{st}$-level GOA unit 10114 and the $2^{nd}$-level GOA unit 10114. Gate electrodes of the third transistors are electrically connected to the level shifter, source electrodes of the third transistors are electrically and correspondingly connected to output terminals of the GOA units 10114, and a drain electrode of each of the third transistors is electrically connected to a stage transmission input terminal of one of the GOA units 10114 at a next level of the corresponding GOA unit 10114. Setting the third transistors can better prevent the GOA circuit 1011 from outputting the scanning signals to the display panel 101 when leakage occurs on the display panel 101.

In one embodiment, the switch module 1012 includes at least two first transistors 10124 and at least two second transistors 10125, the first transistors 10124 are connected in series, and the second transistors 10125 are connected in series. In this way, when one of the first transistors 10124 or one of the second transistor 10125 fails, as the first transistors 10124 are connected in series, and the second transistors 10125 are connected in series, as long as one of the first transistors 10124 and one of the second transistors 10125 have a cut-off effect, the entire overcurrent protection circuit of the display device can prevent the GOA circuit 1011 from outputting the scanning signals to the display panel 101, and the fault tolerance rate of the overcurrent protection circuit of the display device is improved.

Figure 6:
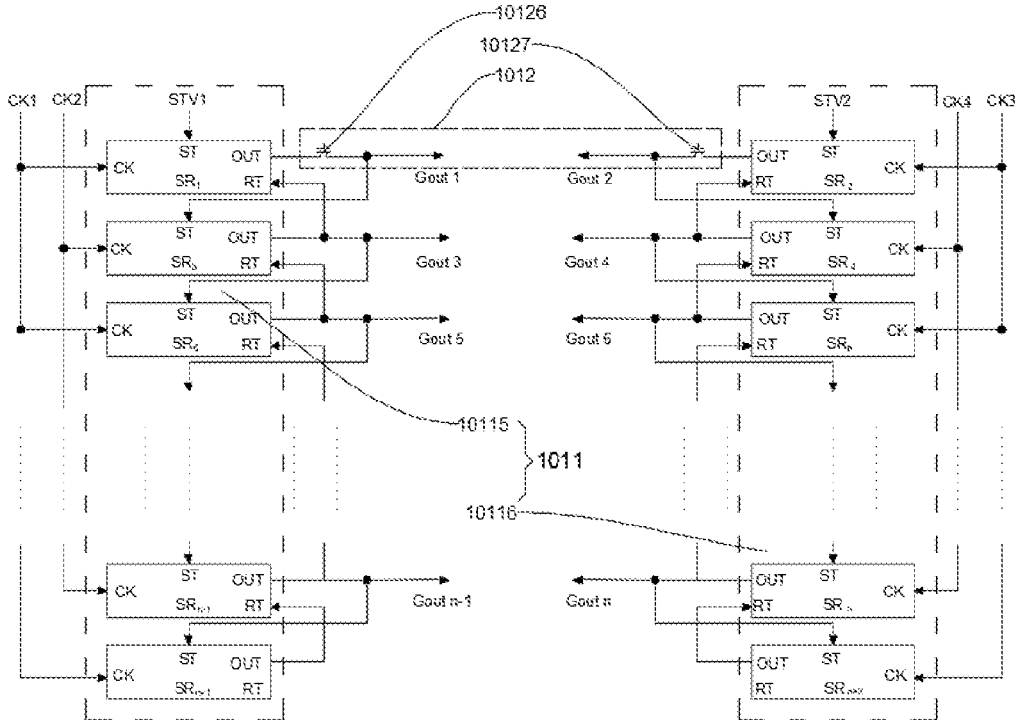
FIG. 6 is a sixth structure schematic view of the display device provided in an embodiment of the present disclosure.

Referring to FIG. 1 and FIG. 6, FIG. 6 is a sixth structure schematic view of the display device provided in an embodiment of the present disclosure. As shown in FIG. 6, in an overcurrent protection circuit of the display device provided in the embodiment of the present disclosure, the GOA circuit 1011 includes a plurality of odd level GOA units 10115 arranged in cascade and a plurality of even level GOA units 10116 arranged in cascade, and the switch module 1012 includes a plurality of fourth transistors 10126 and a plurality of fifth transistors 10127. Wherein in the plurality of odd level GOA units 10115 arranged in cascade, the fourth transistors 10126 are electrically connected to the level shifter 102 and the display panel 101, and in the plurality of even level GOA units 10116 arranged in cascade, the fifth transistors 10127 are electrically connected to the level shifter 102 and the display panel 101.

It can be understood that the GOA circuit 1011 includes a plurality of odd level GOA units 10115 arranged in cascade and a plurality of even level GOA units 10116 arranged in cascade, wherein half of the display panel 101 display is generally controlled by the odd level GOA units 10115 arranged in cascade, and the another half of the display panel 101 display is generally controlled by the even level GOA units 10116 arranged in cascade. Therefore, the fourth transistors 10126 are disposed to prevent the odd level GOA units 10115 arranged in cascade from outputting a control signal to the display panel 101, and the fifth transistors 10127 are disposed to prevent the even level GOA units 10116 arranged in cascade from outputting the control signal to the display panel 101. Specific locations and numbers of the fourth transistors 10126 and the fifth transistors 10127 can refer to the above embodiments, which will not be described in detail herein.

In the display device provided by the present disclosure, the transistors are disposed on the display panel, when the display panel has a short-circuit, the level shifter will detect a large current in the display panel and send a signal to the timing controller, the timing controller sends a feedback signal to the level shifter, and then the level shifter will disconnect the transistors, so as to make the display panel cannot receive scanning signals transmitted from the GOA circuit, which makes the display panel enter the overcurrent protection state to prevent GOA wirings in the display panel from burning out in the event of the short-circuit. Therefore, a structure of the display device provided by the present disclosure is simple, the overcurrent protection of the display device provided by the present disclosure is effective, and the technical problems of complicated structure and poor effect of the OCP protection circuit in conventional GOA panels can be solved.

In the electronic equipment provided by the present disclosure, the electronic equipment includes a display device, wherein the display device is similar to the above display device 10 in structure and principle, including a display panel, a level shifter connected to the display panel, and a timing controller connected to the level shifter, so it will not be described in detail herein.

In the embodiment of the present disclosure, as shown in FIG. 2 and FIG. 6, STV is the stage transmission signal, $STV_1$ is a first stage transmission signal, $STV_2$ is a second stage transmission signal, CK1 is a first timing signal, CK2 is a second timing signal, OUT is the output terminal of each of the GOA units, CK is an input terminal of a timing signal of each of the GOA units, ST is an input terminal of a stage transmission signal of each of the GOA units, $SR_1$, $SR_2$, $SR_3$, $SR_4$, $SR_5$, $SR_6$, $SR_{n-1}$, $SR_n$, $SR_{n+1}$, and $SR_{n+2}$ are the shift registers of the GOA units, RT is an input terminal of a pull-down signal of each of the GOA units, $Gout_1$, $Gout_2$, $Gout_3$, $Gout_4$, $Gout_5$, $Gout_6$, $Gout_{n-1}$, and $Gout_n$ are scanning signal input terminals of the display panel.

In the above embodiments, description of each embodiment has its own emphasis. For parts not detailed in one embodiment can refer to the relevant description of other embodiments.

The display device provided in the embodiment of the present disclosure is described in detail above. Specific examples are applied to explain principle and implementation mode of the present disclosure in this paper. The description of the above embodiments is merely used to help understand the technical solution and core idea of the application. The ordinary person skilled in the art shall understand that they can still modify the technical solution recorded in the above embodiments, or replace some of the technical features equally. These modifications or substitutions do not make the nature of the corresponding technical solution deviate from the scope of the technical solution of the embodiments of the present disclosure.

What is claimed is:

1. A display device, comprising a display panel, a level shifter connected to the display panel, and a timing controller connected to the level shifter, wherein a gate driver on array (GOA) circuit and a switch module are disposed on the display panel, the switch module is connected to the level shifter, and the GOA circuit is electrically connected to scanning lines on the display panel through the switch module; and wherein the GOA circuit comprises a plurality of GOA units arranged in cascade, and the switch module comprises at least one transistor; a gate electrode of the at least one transistor is electrically connected to the level shifter, a source electrode of the at least one transistor is electrically and correspondingly connected to a scanning signal output terminal of the GOA units, and a drain electrode of the at least one transistor is connected to a corresponding one of the scanning lines of the display panel; and wherein when the level shifter detects an occurrence of a short-circuit of the display panel, the level shifter sends a feedback signal to the timing controller, the timing controller sends a short-circuit protection signal to the level shifter according to the feedback signal, and the level shifter outputs a disconnection signal to the switch module according to the short-circuit protection signal to disconnect the switch module.

2. The display device in claim 1, wherein the switch module comprises a plurality of transistors, and the GOA units are in a one-to-one correspondence to the transistors; and wherein a gate electrode of each of the transistors is electrically connected to the level shifter, a source electrode of each of the transistors is electrically and correspondingly connected to a scanning signal output terminal of the GOA units, and a drain electrode of each of the transistors is electrically and correspondingly connected to the scanning lines on the display panel.

3. The display device in claim 2, wherein the transistors are field effect transistors, middle terminals of the field effect transistors are gate electrodes, signal input terminals of the field effect transistors are source electrodes, and signal output terminals of the field effect transistors are drain electrodes.

4. The display device in claim 1, wherein the switch module comprises a transistor; and wherein a gate electrode of the transistor is electrically connected to the level shifter, a source electrode of the transistor is electrically connected to an output terminal of a $1^{st}$-level GOA unit, and a drain electrode of the transistor is correspondingly connected to the scanning lines on the display panel and a stage transmission input terminal of a $2^{nd}$-level GOA unit.

5. The display device in claim 1, wherein the switch module comprises one transistor; and wherein a gate electrode of the one transistor is electrically connected to the level shifter, a source electrode of the one transistor is electrically connected to an output terminal of an initial stage transmission signal, a drain electrode of the one transistor is connected to a stage transmission input terminal of a $1^{st}$-level GOA unit.

6. The display device in claim 1, wherein the switch module comprises a first transistor and a second transistor; and wherein a gate electrode of the first transistor and a gate electrode of the second transistor are electrically connected to the level shifter, a source electrode of the first transistor and a source electrode of the second transistor are electrically connected to an output terminal of a $1^{st}$-level GOA unit, a drain electrode of the first transistor is correspondingly connected to the scanning lines on the display panel, and a drain electrode of the second transistor is electrically connected to a stage transmission input terminal of a $2^{nd}$-level GOA unit.

7. The display device in claim 6, wherein the switch module further comprises a plurality of third transistors, the third transistors are in a one-to-one correspondence to the GOA units except the $1^{st}$-level GOA unit and the $2^{nd}$-level GOA unit; and wherein gate electrodes of the third transistors are electrically connected to the level shifter, source electrodes of the third transistors are electrically and correspondingly connected to output terminals of the GOA units, and a drain electrode of each of the third transistors is electrically connected to a stage transmission input terminal of one of the GOA units at a next level of the corresponding GOA unit.

8. The display device in claim 6, wherein the switch module comprises at least two first transistors and at least two second transistors, the first transistors are connected in series, and the second transistors are connected in series.

9. The display device in claim 1, wherein the GOA circuit comprises a plurality of odd level GOA units arranged in cascade and a plurality of even level GOA units arranged in cascade, and the switch module comprises a plurality of fourth transistors and a plurality of fifth transistors; and wherein in the plurality of odd level GOA units arranged in cascade, the fourth transistors are electrically connected to the level shifter and the display panel, and in the plurality of even level GOA units arranged in cascade, the fifth transistors are electrically connected to the level shifter and the display panel.

10. An electronic equipment, comprising a display panel, a level shifter connected to the display panel, and a timing controller connected to the level shifter, wherein a GOA circuit and a switch module are disposed on the display panel, the switch module is connected to the level shifter, and the GOA circuit is electrically connected to scanning lines on the display panel through the switch module; and wherein the GOA circuit comprises a plurality of GOA units arranged in cascade, and the switch module comprises at least one transistor; a gate electrode of the at least one transistor is electrically connected to the level shifter, a source electrode of the at least one transistor is electrically and correspondingly connected to a scanning signal output terminal of the GOA units, and a drain electrode of the at least one transistor is connected to a corresponding one of the scanning lines of the display panel; and wherein when the level shifter detects an occurrence of a short-circuit of the display panel, the level shifter sends a feedback signal to the timing controller, the timing controller sends a short-circuit protection signal to the level shifter according to the feedback signal, and the level shifter outputs a disconnection signal to the switch module according to the short-circuit protection signal to disconnect the switch module.

11. The electronic equipment in claim 10, wherein the switch module comprises a plurality of transistors, and the GOA units are in a one-to-one correspondence to the transistors; and wherein a gate electrode of each of the transistors is electrically connected to the level shifter, a source electrode of each of the transistors is electrically and correspondingly connected to a scanning signal output terminal of the GOA units, and a drain electrode of each of the transistors is electrically and correspondingly connected to the scanning lines on the display panel.

12. The electronic equipment in claim 11, wherein the transistors are field effect transistors, middle terminals of the field effect transistors are gate electrodes, signal input terminals of the field effect transistors are source electrodes, and signal output terminals of the field effect transistors are drain electrodes.

13. The electronic equipment in claim 10, wherein the switch module comprises one transistor; and wherein a gate electrode of the one transistor is electrically connected to the level shifter, a source electrode of the one transistor is electrically connected to an output terminal of a $1^{st}$-level GOA unit, and a drain electrode of the one transistor is correspondingly connected to the scanning lines on the display panel and a stage transmission input terminal of a $2^{nd}$-level GOA unit.

14. The electronic equipment in claim 10, wherein the switch module comprises a transistor; and wherein a gate electrode of the transistor is electrically connected to the level shifter, a source electrode of the transistor is electrically connected to an output terminal of an initial stage transmission signal, a drain electrode of the transistor is connected to a stage transmission input terminal of a $1^{st}$-level GOA unit.

15. The electronic equipment in claim 10, wherein the switch module comprises a first transistor and a second transistor; and wherein a gate electrode of the first transistor and a gate electrode of the second transistor are electrically connected to the level shifter, a source electrode of the first transistor and a source electrode of the second transistor are electrically connected to an output terminal of a 1$^{st}$-level GOA unit, a drain electrode of the first transistor is correspondingly connected to the scanning lines on the display panel, and a drain electrode of the second transistor is electrically connected to a stage transmission input terminal of a 2$^{nd}$-level GOA unit.

16. The electronic equipment in claim 15, wherein the switch module further comprises a plurality of third transistors, the third transistors are in a one-to-one correspondence to the GOA units except the 1$^{st}$-level GOA unit and the 2$^{nd}$-level GOA unit; and wherein gate electrodes of the third transistors are electrically connected to the level shifter, source electrodes of the third transistors are electrically and correspondingly connected to output terminals of the GOA units, and a drain electrode of each of the third transistors is electrically connected to a stage transmission input terminal of one of the GOA units at a next level of the corresponding GOA unit.

17. The electronic equipment in claim 16, wherein the switch module comprises at least two first transistors and at least two second transistors, the first transistors are connected in series, and the second transistors are connected in series.

18. The electronic equipment in claim 10, wherein the GOA circuit comprises a plurality of odd level GOA units arranged in cascade and a plurality of even level GOA units arranged in cascade, and the switch module comprises a plurality of fourth transistors and a plurality of fifth transistors; and wherein in the plurality of odd level GOA units arranged in cascade, the fourth transistors are electrically connected to the level shifter and the display panel, and in the plurality of even level GOA units arranged in cascade, the fifth transistors are electrically connected to the level shifter and the display panel.

* * * * *